US009677373B2

(12) United States Patent
Harris

(10) Patent No.: US 9,677,373 B2
(45) Date of Patent: Jun. 13, 2017

(54) DOWNHOLE TOOL WITH ANTI-EXTRUSION DEVICE

(71) Applicant: TEAM OIL TOOLS, LP, The Woodlands, TX (US)

(72) Inventor: Michael J. Harris, Houston, TX (US)

(73) Assignee: TEAM OIL TOOLS, LP, The Woodlands, TX (US)

( * ) Notice: Subject to any disclaimer, the term of this patent is extended or adjusted under 35 U.S.C. 154(b) by 323 days.

(21) Appl. No.: 14/530,037

(22) Filed: Oct. 31, 2014

(65) Prior Publication Data

US 2016/0123104 A1 May 5, 2016

(51) Int. Cl.
*E21B 33/129* (2006.01)
*E21B 33/12* (2006.01)

(52) U.S. Cl.
CPC ..... *E21B 33/1216* (2013.01)

(58) Field of Classification Search
CPC ..... E21B 23/06; E21B 33/12; E21B 33/128; E21B 33/129
USPC ..... 166/118, 123, 181, 196
See application file for complete search history.

(56) References Cited

U.S. PATENT DOCUMENTS 6,695,050 B2 * 2/2004 Winslow ..... E21B 33/1293 166/118
6,712,153 B2 * 3/2004 Turley ..... E21B 33/1208 166/118
7,373,973 B2 * 5/2008 Smith ..... E21B 33/1216 166/134
7,810,558 B2 * 10/2010 Shkurti ..... E21B 33/134 166/138
8,403,036 B2 * 3/2013 Neer ..... E21B 33/1216 166/118
8,997,853 B2 * 4/2015 VanLue ..... E21B 33/128 166/118
9,441,448 B2 * 9/2016 Frazier ..... E21B 33/1216
2003/0226659 A1 * 12/2003 Smith ..... E21B 33/1216 166/118
2010/0263857 A1 * 10/2010 Frazier ..... E21B 33/1294 166/127
2010/0288487 A1 * 11/2010 Turley ..... E21B 33/1208 166/118
2013/0213672 A1 * 8/2013 Nutley ..... E21B 17/10 166/382
2016/0123100 A1 * 5/2016 Tse ..... E21B 23/06 166/387

* cited by examiner

*Primary Examiner* — Kenneth L Thompson
(74) *Attorney, Agent, or Firm* — MH2 Technology Law Group, LLP

(57) ABSTRACT

A downhole tool including a mandrel, a sealing element, a cone, a plurality of fingers, and a slip. The sealing element may be positioned around the mandrel. The sealing element is configured to expand radially-outward from a contracted state to an expanded state. The cone may be positioned around the mandrel and proximate to the sealing element. The plurality of fingers may be positioned at least partially around the mandrel. The fingers may be axially-aligned with at least a portion of the sealing element. The fingers are coupled to a base and configured to break away from the base at a weak point when the sealing element expands into the expanded state. The slip may be positioned around the mandrel and proximate to the cone. The slip may include a tapered inner surface configured to slide along a tapered outer surface of the cone.

17 Claims, 3 Drawing Sheets

DOWNHOLE TOOL WITH ANTI-EXTRUSION DEVICE

BACKGROUND

In the oilfield industry, various downhole tools (e.g., packers, bridge plugs, frac plugs) may be used to isolate sections of a wellbore. These downhole tools generally include a central body or "mandrel." Slips, a sealing element, and a set of components configured to expand the slips and sealing element are positioned on the mandrel so that the tool can be set, generally by application of an axially-directed, compressive force.

During setting, the slips expand outwards to grip the interior of a casing string (or another surrounding tubular in the wellbore), and the sealing element expands outwards to seal with the casing string. In the expanded state, the slips may maintain the position of the tool in the casing string, while the sealing element may isolate upper and lower portions of an annulus defined between the tool and the casing string.

The sealing element may be made from a deformable material, such as rubber. Such materials may, however, be prone to extrusion (e.g., axial expansion) along the mandrel during setting. Extrusion of the sealing element may reduce the ability of the sealing element to form a seal with the casing string. Thus, such tools are generally provided with one or more back-up rings, which are designed to prevent extrusion of the sealing element.

However, the back-up rings are generally constructed from soft materials, e.g., composites, to facilitate drilling through the tools when their use is complete. Back-up rings made from such soft materials may be prone to failure in the wellbore, such that the back-up rings may allow extrusion of the sealing element.

SUMMARY

A downhole tool is disclosed. The tool may include a mandrel and a sealing element positioned around the mandrel. The sealing element is configured to expand radially-outward from a contracted state to an expanded state. A cone may be positioned around the mandrel and proximate to the sealing element. A plurality of fingers may be positioned at least partially around the mandrel. The fingers may be axially-aligned with at least a portion of the sealing element. The fingers may be coupled to a base and configured to break away from the base at a weak point when the sealing element expands into the expanded state. A slip may be positioned around the mandrel and proximate to the cone. The slip includes a tapered inner surface configured to slide along a tapered outer surface of the cone.

In another embodiment, the downhole tool may include a mandrel and a sealing element positioned around the mandrel. The sealing element is configured to expand radially-outward from a contracted state to an expanded state. A cone may be positioned around the mandrel and proximate to the sealing element. A plurality of fingers may be coupled to a base. The fingers may be configured to break away from the base at a weak point in response to the sealing element moving to the expanded state. A ring may be positioned around the mandrel and at least partially between the sealing element and at least one of the fingers. A slip may be positioned around the mandrel and proximate to the cone. The slip includes a tapered inner surface configured to slide along a tapered outer surface of the cone. A collar may be positioned around the mandrel and proximate to the slip. The collar is configured to move with respect to the mandrel toward the sealing element.

A method for actuating a downhole tool in a wellbore is also disclosed. The method may include running the downhole tool into the wellbore. The downhole tool may include a mandrel. A sealing element may be positioned around the mandrel. A cone may be positioned around the mandrel and proximate to the sealing element. A plurality of fingers may be positioned at least partially around the mandrel. The fingers may be axially-aligned with at least a portion of the sealing element, and the fingers may be coupled to a base. A slip may be positioned around the mandrel and proximate to the cone. The slip includes a tapered inner surface configured to slide along a tapered outer surface of the cone. An axial compression force may be applied to the sealing element, the cone, and the slip with a setting tool. The compression force may cause the sealing element to expand radially-outward from a contracted state to an expanded state. The fingers may break away from the base when the sealing element expands into the expanded state.

BRIEF DESCRIPTION OF THE DRAWINGS

The invention may best be understood by referring to the following description and accompanying drawings that are used to illustrate embodiments of the invention. In the drawings.

DETAILED DESCRIPTION

Figure 1:
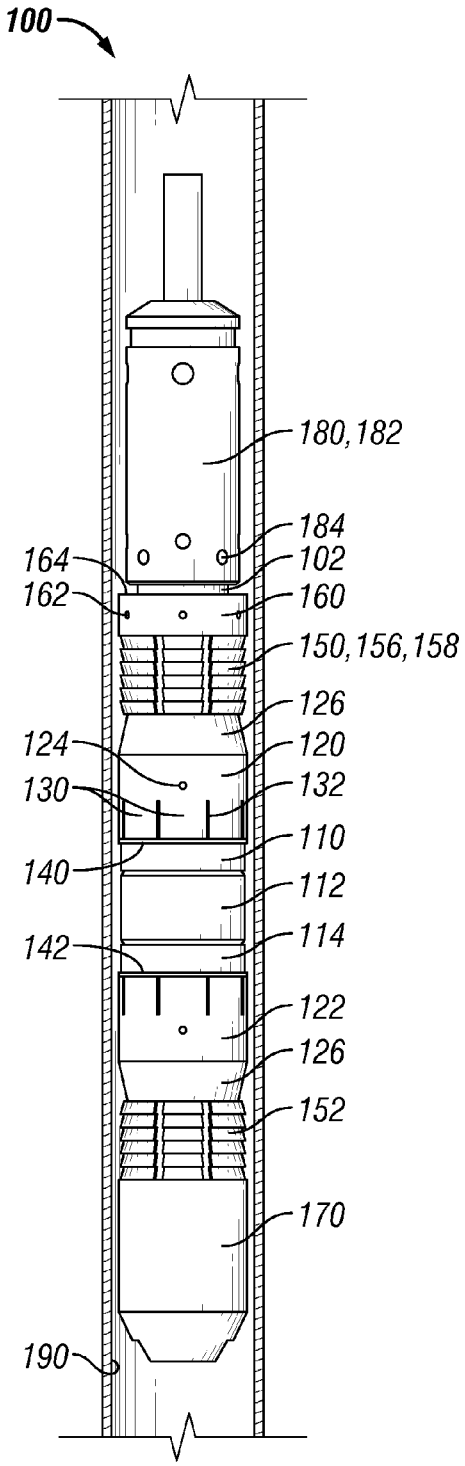
FIG. 1 illustrates a side view of a downhole tool in a contracted state, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

In general, the present disclosure provides a downhole tool that includes a setting assembly having, among other components, cones and a plurality of fingers. In an embodiment, the fingers may be coupled with the cones, e.g., may be integrally-formed therewith. Further, the fingers may be disposed adjacent to a sealing element of the downhole tool. A ring, e.g., a thin, optionally metal ring, may be interposed between the fingers and the sealing element.

The downhole tool may be run into a casing string, or any other tubular, to a desired location therein. The tool may then be set, which may include expanding the sealing element by application of an axially-compressive force thereto via the cones and fingers. During such setting, the fingers may be broken, ruptured, or otherwise detached from one another and the cone by the reactionary force applied thereto by the sealing element. The fingers, once detached, may then be lodged between the tool and the surrounding tubular, such that the reactionary forces applied by the axially-compressed sealing element may be transmitted to the casing via compressive loading of the fingers. Further, the ring may prevent extrusion of the sealing element, between the fingers.

Figure 2:
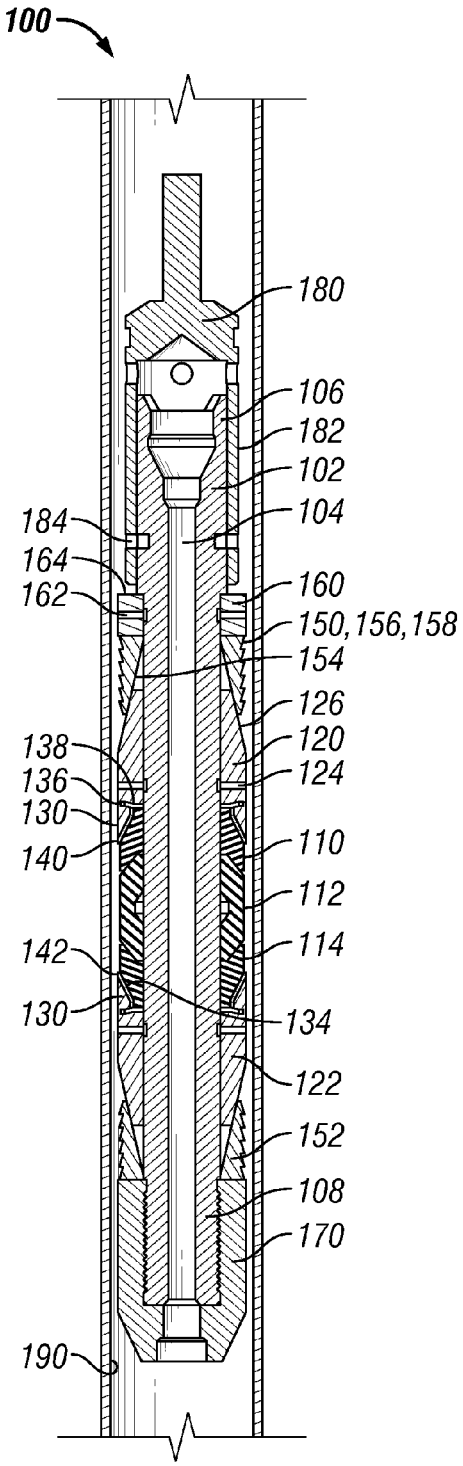
FIG. 2 illustrates a side, cross-sectional view of the downhole tool in the contracted state, according to an embodiment.

Turning to the specific, illustrated embodiments, FIGS. 1 and 2 illustrate a side view and a side, cross-sectional view, respectively, of a downhole tool 100 in a run-in position (also referred to herein as a "contracted state"), according to an embodiment. The downhole tool 100 may be any tool that is designed to be run into a wellbore and isolate, whether permanently or selectively, two or more sections in the wellbore. For example, the downhole tool 100 may be a packer, a bridge plug, a frac plug, a caged-ball frac plug, a drop-ball frac plug, or the like. As such, the downhole tool 100 may include one or more valve seats, plugs, balls, pins, cages, etc. One or more (e.g., any or all of the) components in the downhole tool 100 may be made from a composite material, as discussed in more detail below.

In an embodiment, the downhole tool 100 may include a mandrel 102, as best shown in FIG. 2. The mandrel 102 may be a tubular member with an axial bore 104 formed at least partially therethrough. The mandrel 102 may be formed from one or more metals such as aluminum or steel, or the mandrel 102 may be formed from a composite material such as fiber glass with epoxy resins. Further, the mandrel 102 may be a unitary structure, or may be formed from two or more sections that are coupled together.

One or more sealing elements (three are shown: 110, 112, 114) may be positioned around the mandrel 102. Specifically, in the illustrated embodiment, a first or "upper" sealing element 110, a second or "middle" sealing element 112, and a third or "lower" sealing element 114 are provided. The sealing elements 110, 112, 114 may be configured to actuate radially-outward from a contracted state (FIGS. 1 and 2) to an expanded state (FIGS. 4 and 5), as discussed in greater detail below. The sealing elements 110, 112, 114 may be formed from one or more elastomeric materials (e.g., rubber) of any suitable hardness, or any other material designed to provide a seal with a surrounding tubular 190.

One or more cones (two are shown: 120, 122) may be positioned around the mandrel 102. As shown, a first or "upper" cone 120 may be positioned between the sealing elements 110, 112, 114 and a first or "upper" end 106 of the mandrel 102, and a second or "lower" cone 122 may be positioned between the sealing elements 110, 112, 114 and a second or "lower" end 108 of the mandrel 102. The cones 120, 122 may be coupled to the mandrel 102 with one or more shear mechanisms 124. The shear mechanisms 124 may be or include pins, screws, studs, or the like, and may be configured to break when exposed to a predetermined axial and/or rotational force. The cones 120, 122 may include tapered outer surfaces 126. For example, the outer surfaces 126 of the cones 120, 122 may increase in diameter moving in a direction parallel to a central longitudinal axis of the mandrel 102 and toward the sealing elements 110, 112, 114. The cones 120, 122 may be formed from one or more metals such as aluminum, steel, or cast iron, or the cones 120, 122 may be formed from a composite material such as fiber glass with epoxy resins.

One or more fingers 130 may be positioned around the mandrel 102. The fingers 130 may be at least partially axially-aligned with and positioned radially-outward from at least one of the sealing elements 110, 112, 114. The fingers 130 may be coupled together at least partially around the mandrel 102 via a base. In at least one embodiment, the base may be a part of or integral with one of the cones 120, 122. In another embodiment, the base may be another component, e.g., a back-up ring, that is separate from the cones 120, 122. In still another embodiment, the base may be formed solely by connections between adjacent fingers 130.

In the illustrated embodiment, each cone 120, 122 includes a plurality of the fingers 130. Further, the fingers 130 of each cone 120, 122 may be circumferentially-offset from one another and separated by axial slots 132. The fingers 130 may include tapered inner surfaces 134. For example, the inner surfaces 134 of the fingers 130 may increase in diameter moving in a direction parallel to a central longitudinal axis of the mandrel 102 and toward the sealing elements 110, 112, 114.

A weak point 136 may exist between each finger 130 and the base (e.g., the remainder of the corresponding cone 120, 122). The weak points 136 may be caused by a recess 138 that reduces the thickness of the cones 120, 122 at this location. As discussed in greater detail below, the weak points 136 are designed to break, allowing the fingers 130 to separate from the remainder of the cones 120, 122 when a predetermined axial and/or radial force is applied to the fingers 130.

One or more rings 140, 142 may optionally be positioned around the mandrel 102. As shown, a first or "upper" ring 140 may be positioned between the sealing elements 110, 112, 114 and the upper cone 120, and a second or "lower"

ring 142 may be positioned between the sealing elements 110, 112, 114 and the lower cone 122. The rings 140, 142 may be at least partially axially-aligned with (e.g., disposed at a common axial location with respect to the mandrel 102) at least one of the sealing elements 110, 112, 114 and/or the fingers 130 of a corresponding cone 120, 122. For example, the upper ring 140 may be at least partially axially-aligned with and positioned radially-between the upper sealing element 110 and the fingers 130 of the upper cone 120. Likewise, the lower ring 142 may be at least partially axially-aligned with and positioned radially-between the lower sealing element 114 and the fingers 130 of the lower cone 122. The rings 140 may be tapered. For example, the rings 140 may increase in diameter (e.g., and inner and/or outer diameter) moving in a direction parallel to a central longitudinal axis of the mandrel 102 and toward the sealing elements 110, 112, 114. Further, the rings 140 may maintain a generally constant thickness. Moreover, the rings 140 may be made of one or more metals such as aluminum or steel.

One or more slips (two are shown: 150, 152) may be positioned around the mandrel 102. As shown, a first or "upper" slip 150 may be positioned at least partially between the upper cone 120 and the upper end 106 of the mandrel 102, and a second or "lower" slip 152 may be positioned at least partially between the lower cone 122 and the lower end 108 of the mandrel 102. The slips 150, 152 may include tapered inner surfaces 154. For example, the inner surfaces 154 of the slips 150, 152 may increase in diameter moving in a direction parallel to a central longitudinal axis of the mandrel 102 and toward the sealing elements 110, 112, 114. The inner surfaces 154 of the slips 150, 152 may be oriented at generally the same angle as the outer surfaces 126 of the cones 120, 122, enabling the slips 150, 152 to slide or ramp onto the cones 120, 122, as described in greater detail below. The outer surfaces 156 of the slips 150, 152 may include a plurality of teeth 158. The teeth 158 may be axially and/or circumferentially-offset from one another. The teeth 158 may be configured to engage a surrounding tubular or wellbore wall 190 positioned radially-outward therefrom when the downhole tool 100 is in the expanded state. When this occurs, the teeth 158 may secure the downhole tool 100 axially in place in the wellbore. The slips 150, 152 may be formed from one or more metals such as aluminum, cast iron, or steel, or may be made from a composite such as a fiber glass with epoxy resins and one or more inserts or "buttons" of a harder material, which may provide the teeth 158. The buttons may be made from carbide or heat-treated steel. The buttons may be circumferentially-offset and/or axially-offset from one another around a central longitudinal axis through the mandrel 102. The buttons may have a cross-sectional shape that is a circle, an oval, a rectangle, or the like, and an outer surface of the buttons may be oriented at an acute angle with respect to the central longitudinal axis through the mandrel 102.

A collar 160 may be positioned around the mandrel 102. As shown, the collar 160 may be positioned between the upper slip 150 and the upper end 106 of the mandrel 102. The collar 160 may be coupled to the mandrel 102 with one or more shear mechanisms 162. The collar 160 may include a shoulder surface 164 that may be substantially horizontal with respect to the central longitudinal axis through the mandrel 102. Further, the collar 160 may include a locking mechanism, such as a lock ring or the like, configured to maintain the position of the collar 160 in at least one axial direction along the mandrel 102, when the tool 100 is moved to an expanded state (i.e., "set"). A setting tool 180 may contact and apply a downward force onto the shoulder surface 164 so as to set the tool 100, as described in more detail below.

An end cap 170 may be positioned around the mandrel 102. As shown, the end cap 170 may include threads that engage corresponding threads on the outer surface of the mandrel 102, proximate to the second end 108 of the mandrel 102.

The setting tool 180 may be at least partially positioned around the mandrel 102. As shown, the setting tool 180 may include a first portion 182, which may be a setting sleeve. The first portion 182 may be positioned around the mandrel 102 and coupled to the mandrel 102 with one or more shear mechanisms 184. The first portion 182 may be positioned proximate to the collar 160. Although not shown, the setting tool 180 may also include a second portion that is positioned at least partially within the mandrel 102 and coupled to the mandrel 102. The second portion may be threaded into the mandrel 102 and/or coupled to the mandrel 102 with one or more shear mechanisms. In the latter case, the shear mechanism(s) coupling the second portion to the mandrel 102 may be configured to break in response to a higher load than the shear mechanism(s) 184.

Figure 3:
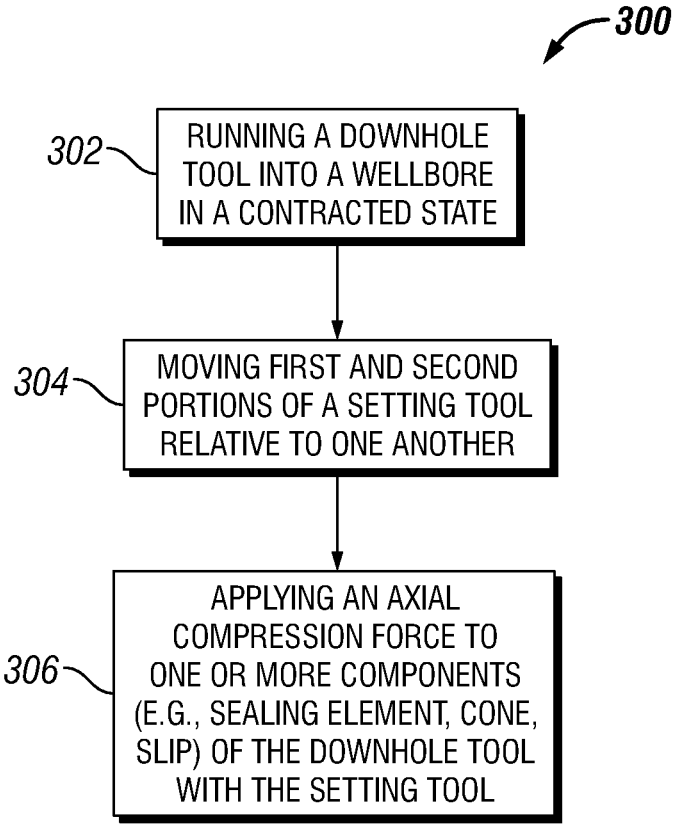
FIG. 3 illustrates a flowchart of a method for actuating the downhole tool, according to an embodiment.

FIG. 3 illustrates a flowchart of a method 300 for actuating the downhole tool 100, according to an embodiment. The downhole tool 100 may be run into a wellbore 104 in the contracted state while coupled to the setting tool 180, as at 302. The downhole tool 100 may be run into the wellbore by lowering the downhole tool 100 using the weight of the downhole tool 100. In another embodiment, the downhole tool 100 may be run into the wellbore by pushing the downhole tool 100 with a push member, such as a coiled tubing or a stick pipe. In yet another embodiment, the downhole tool 100 may be run into the wellbore by pumping the downhole tool 100 into the wellbore from the surface while the downhole tool 100 is connected to a control line or a wireline.

When at the desired depth, the first portion 182 and the second portion of the setting tool 180 may be moved in relative to one another, as at 304. In one embodiment, the first portion 182 of the setting tool 180 may be pressed downward toward the collar 160 while the second portion of the setting tool 180 remains in place or is pulled upward toward the surface. In another embodiment, the first portion 182 of the setting tool 180 may remain in place while the second portion of the setting tool 180 is pulled upward. This may cause the one or more shear mechanisms 184 coupling the first portion 182 of the setting tool 180 to the mandrel 102 to break, thereby allowing the first portion 182 of the setting tool 180 to move with respect to the mandrel 102.

With continued opposing forces between the first portion 182 and the second portion of the setting tool 180, the first portion 182 of the setting tool 180 may then move into contact with the collar 160 and exert a downward force thereon. This may cause the one or more shear mechanisms 162 coupling the collar 160 to the mandrel 102 to break, thereby allowing the collar 160 to move with respect to the mandrel 102.

With continued opposing forces between the first portion 182 and the second portion of the setting tool 180, the collar 160 may move downward toward the end cap 170, causing the distance between the collar 160 and the end cap 170 to decrease. This may exert an axial compression force on the components between the collar 160 and the end cap 170, which may actuate the downhole tool 100 into the expanded state, as at 306. As will be appreciated, the components may include the sealing elements 110, 112, 114, the cones 120, 122, the rings 140, 142, the slips 150, 152, or a combination thereof.

Figure 4:
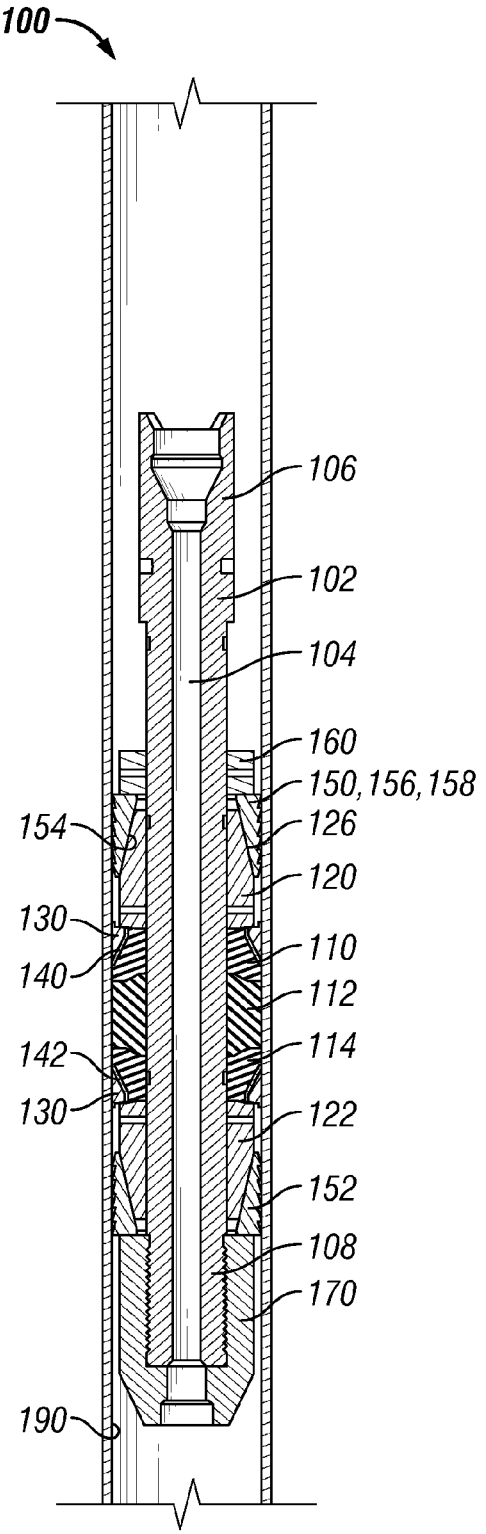
FIG. 4 illustrates a side, cross-sectional view of the downhole tool after the downhole tool has been actuated into an expanded state, according to an embodiment.

FIG. 4 illustrates a side, cross-sectional view of the downhole tool 100 after the downhole tool 100 has been actuated into the expanded state, according to an embodiment. Referring to FIGS. 3 and 4, the axial compression force may cause the slips 150, 152 to move axially toward one another. As the slips 150, 152 move toward one another, the tapered inner surfaces 154 of the slips 150, 152 may slide along the tapered outer surfaces 126 of the cones 120, 122, causing the slips to simultaneously move radially-outward until the teeth 158 on the outer surface 156 of the slips 150, 152 contact the surrounding tubular 190 to secure the downhole tool 100 in place. The surrounding tubular 190 may be a casing, a liner, another tubular component run into the wellbore, or the wall of the wellbore itself.

As the slips 150, 152 move, they may exert an axial compression force on the cones 120, 122. This may cause the one or more shear mechanisms 124 coupling the cones 120, 122 to the mandrel 102 to break, thereby allowing the cones 120, 122 to move with respect to the mandrel 102. The continued axial compression force may cause the cones 120, 122 to move axially toward one another. This may compress the sealing elements 110, 112, 114, causing the sealing elements 110, 112, 114 to expand radially-outward into contact with the surrounding tubular 190. As the sealing elements 110, 112, 114 expand, the rings 140 may guide sealing elements 110, 112, 114 in the desired direction (e.g., radially-outward), while preventing expansion axially. In at least one embodiment, the radial expansion of the sealing elements 110, 112, 114 may cause the rings 140 to expand radially-outward as well.

In addition, the forces exerted on the sealing elements 110, 112, 114 by the cones 120, 122 may cause the fingers 130 to break away from the base when the sealing elements 110, 112, 114 expand radially-outward into the second state. For example, the fingers 130 may be designed to break away from the remainder of the cones 120, 122 at the weak points 136 when the force between the sealing elements 110, 112, 114 and the cones 120, 122 (e.g., the fingers 130 and/or the remainder) is less than or equal to the force between the sealing elements 110, 112, 114 and the cones 120, 122 needed to expand the sealing elements 110, 112, 114 radially-outward. When this occurs, the fingers 130 may be pinned between the sealing elements 110, 112, 114, the rings 140, and/or the cones 120, 122 on one side and the surrounding tubular 190 on the other side.

As such, the reactionary forces applied by the sealing elements 110, 112, 114 being compressed between the cones 120, 122, onto the fingers 130, may be transmitted to the wellbore wall 190 via compressive loading of the fingers 130. Yielding of the fingers 130 may not be a concern, as such breakage may be intended. Extrusion between the fingers 130 may then be prevented by the rings 140.

Figure 5:
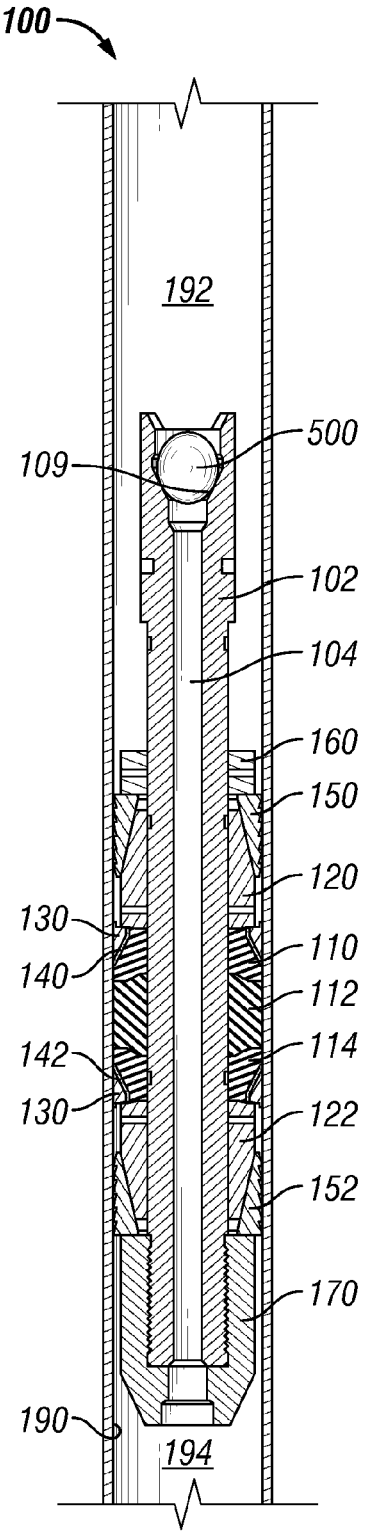
FIG. 5 illustrates a side, cross-sectional view of the downhole tool in the expanded state with an impediment obstructing fluid flow through the tool, according to an embodiment.

FIG. 5 illustrates a side, cross-sectional view of the downhole tool 100 in the expanded state with an impediment 500 obstructing fluid flow through the tool 100, according to an embodiment. The impediment 500 may be a ball, a dart, a plug, or the like. For example, the impediment 500 may be a drop ball (as shown), a caged ball, or a plug. When the impediment 500 is a drop ball, the impediment 500 may be introduced into the wellbore from a surface location, and fluid may be pumped into the wellbore (e.g., by a pump at the surface location), causing the impediment 500 to flow toward the downhole tool 100. The impediment 500 may come to rest in a seat 109 formed in the inner surface of the mandrel 102. In another embodiment, the drop ball may be run into the wellbore with the downhole tool 100 (e.g., on the seat 109).

When the impediment 500 is a caged ball, the impediment 500 may be run into the wellbore with the downhole tool 100. The caged ball may be positioned axially-between the seat 109 and one or more pins (not shown). In the drop ball and caged ball embodiments, the impediment 500 may prevent fluid flow through the axial bore 104 one direction (e.g., downward), thereby isolating the two sections 192, 194 of the wellbore, while allowing fluid flow in the opposing direction (e.g., upward).

When the impediment 500 is a plug, the impediment 500 may be run into the wellbore with the downhole tool 100. More particularly, the impediment 500 may be engaged with an inner surface of the mandrel 102 (e.g., via a threaded connection). The plug may prevent fluid flow in both axial directions through the bore 104. In this embodiment, the downhole tool 100 is referred to as a bridge plug.

Once the downhole tool 100 is in place in the wellbore, one or more downhole operations may then take place, such as multi-stage stimulation (e.g., hydraulic fracturing) operations. In at least one embodiment, two or more downhole tools 100 may be used to temporarily abandon a wellbore. In this embodiment, the downhole tools 100 may be bridge plugs, and, pumping fluid into the wellbore after the downhole tool 100 is set may not take place. The downhole tool 100 may be used in a vertical, horizontal, or deviated wellbore.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

a mandrel;

a sealing element positioned around the mandrel, wherein the sealing element is configured to expand radially-outward from a contracted state to an expanded state;

a cone positioned around the mandrel and proximate to the sealing element;

a plurality of fingers positioned at least partially around the mandrel, wherein the fingers are axially-aligned with at least a portion of the sealing element, and wherein the fingers are coupled to or integral with a base and configured to break away from the base at a weak point when the sealing element expands into the expanded state; and a slip positioned around the mandrel and proximate to the cone, wherein the slip includes a tapered inner surface configured to slide along a tapered outer surface of the cone, wherein the base is coupled to or integral with the cone, and wherein the cone, the fingers, or a combination thereof defines a recess that reduces a thickness of the cone, the fingers, or the combination thereof, such that the weak point is formed.

2. The downhole tool of claim 1, wherein at least one of the fingers includes a tapered inner surface that increases in diameter moving in a direction parallel to a central longitudinal axis of the mandrel and toward the sealing element.

3. The downhole tool of claim 1, further comprising a ring positioned around the mandrel and at least partially between the sealing element and the cone.

4. The downhole tool of claim 3, wherein the ring is positioned at least partially between the sealing element and at least one of the fingers.

5. The downhole tool of claim 3, wherein the ring is tapered such that a diameter of the ring increases moving in a direction parallel to a central longitudinal axis of the mandrel and toward the sealing element.

6. The downhole tool of claim 5, wherein at least one of the fingers includes a tapered inner surface that increases in diameter moving in the direction parallel to the central longitudinal axis of the mandrel and toward the sealing element, and wherein the tapered inner surface is in contact with and oriented at substantially a same angle as a tapered outer surface of the ring.

7. The downhole tool of claim 5, wherein the ring prevents the sealing element from expanding in an axial direction between the fingers.

8. The downhole tool of claim 7, wherein, after breaking away, at least one of the fingers is configured to be pinned between the sealing element, the ring, the remainder of the cone, or a combination thereof on one side and a surrounding tubular on the other side.

9. The downhole tool of claim 7, wherein the ring is configured to expand radially-outward in response to the sealing element expanding radially-outward.

10. A downhole tool, comprising:

a mandrel;

a sealing element positioned around the mandrel, wherein the sealing element is configured to expand radially-outward from a contracted state to an expanded state;

a cone positioned around the mandrel and proximate to the sealing element;

a base coupled to or integral with the cone;

a plurality of fingers coupled to or integral with the base, wherein the fingers are configured to break away from the base at a weak point in response to the sealing element moving to the expanded state;

a ring positioned around the mandrel and at least partially between the sealing element and at least one of the fingers;

a slip positioned around the mandrel and proximate to the cone, wherein the slip includes a tapered inner surface configured to slide along a tapered outer surface of the cone; and a collar positioned around the mandrel and proximate to the slip, wherein the collar is configured to move with respect to the mandrel toward the sealing element, wherein the cone, the fingers, or a combination thereof defines a recess that reduces a thickness of the cone, the fingers, or the combination thereof, such that the weak point is formed.

11. The downhole tool of claim 10, wherein the ring includes a tapered outer surface that increases in diameter moving in a direction parallel to a central longitudinal axis of the mandrel and toward the sealing element.

12. The downhole tool of claim 11, wherein at least one of the fingers includes a tapered inner surface that increases in diameter moving in the direction parallel to the central longitudinal axis of the mandrel and toward the sealing element.

13. The downhole tool of claim 12, wherein the tapered inner surface is in contact with and oriented at substantially a same angle as the tapered outer surface of the ring.

14. A method for actuating a downhole tool in a wellbore, comprising:

running the downhole tool into the wellbore, wherein the downhole tool comprises:

a mandrel;

a sealing element positioned around the mandrel;

a cone positioned around the mandrel and proximate to the sealing element;

a plurality of fingers positioned at least partially around the mandrel, wherein the fingers are axially-aligned with at least a portion of the sealing element, and wherein the fingers are coupled to or integral with a base; and a slip positioned around the mandrel and proximate to the cone, wherein the slip includes a tapered inner surface configured to slide along a tapered outer surface of the cone, wherein the base is coupled to or integral with the cone, and wherein the cone, the fingers, or a combination thereof defines a recess that reduces a thickness of the cone, the fingers, or the combination thereof, such that a weak point is formed; and applying an axial compression force to the sealing element, the cone, and the slip with a setting tool, wherein the compression force causes the sealing element to expand radially-outward from a contracted state to an expanded state, and wherein the fingers break away from the base at the weak point when the sealing element expands into the expanded state.

15. The method of claim 14, wherein the compression force causes the slip to move along an outer surface of the cone in a direction that is axially toward the sealing element and radially-outward.

16. The method of claim 14, further comprising dropping an impediment into the wellbore, wherein the impediment comes to rest in a seat in the downhole tool such that the impediment prevents fluid flow in at least one direction through an axial bore formed through the mandrel of the downhole tool.

17. The method of claim 14, wherein, after breaking away, at least one of the fingers is configured to be pinned between the sealing element, the remainder of the cone, or a combination thereof on one side and a surrounding tubular on the other side.

* * * * *